US005651346A

United States Patent [19]

Remmels et al.

[11] Patent Number: 5,651,346

[45] Date of Patent: Jul. 29, 1997

[54] ACCUMULATOR-TYPE INJECTION SYSTEM

[75] Inventors: Werner Remmels, Immenstaad; Uwe Breidenbach, Friedrichshafen, both of Germany

[73] Assignee: MTU Motoren- Und Turbinen-Union Friedrichshafen GmbH, Germany

[21] Appl. No.: 577,328

[22] Filed: Dec. 22, 1995

[30] Foreign Application Priority Data

Dec. 22, 1994 [DE] Germany ..... 44 45 980.7

[51] Int. Cl.[6] ..... F02M 43/00; F02M 47/02

[52] U.S. Cl. ..... 123/447; 123/25 C

[58] Field of Search ..... 123/25 C, 506, 123/515, 514, 447, 496

[56] References Cited

U.S. PATENT DOCUMENTS

| | | | |
|---|---|---|---|
| 4,640,252 | 2/1987 | Nakamura et al. | 123/446 |
| 5,170,751 | 12/1992 | Tosa et al. | 123/25 C |
| 5,174,247 | 12/1992 | Tosa et al. | 123/25 C |
| 5,245,953 | 9/1993 | Shimada et al. | 123/25 C |
| 5,377,636 | 1/1995 | Rix et al. | 123/506 |
| 5,526,791 | 6/1996 | Timmer et al. | 123/506 |
| 5,529,024 | 6/1996 | Wirbeleit et al. | 123/25 C |

FOREIGN PATENT DOCUMENTS 43 41 739 C1 3/1995 Germany .

OTHER PUBLICATIONS

Dieseleinspritzung für Grossmotoren, Von Gerhard Lehner, MTZ Motortechnische Zeitschrift 55 (1994), 3 pages.

*Primary Examiner*—Erick R. Solis
*Attorney, Agent, or Firm*—Evenson, McKeown, Edwards & Lenahan, P.L.L.C.

[57] ABSTRACT

An accumulator-type injection system having an injector and a control valve connected with the injector for controlling injection. In a first switching position of the control valve, an injector body fuel duct, which leads in front of the orifices, is connected with a fuel accumulator. In a second switching position, a passage is opened up by the control valve which connects the fuel duct with a return flow. As a result, in the injection pauses, the fuel pressure in front of the orifices can be lowered approximately to the ambient pressure so that the inclusion of water in front of the orifices takes place at a low pressure.

2 Claims, 2 Drawing Sheets

22
21
20
19
18
17
14
16
13
8
9
10
15
11
12
6
25
23
5
24
1
2
3
4

ACCUMULATOR-TYPE INJECTION SYSTEM

BACKGROUND AND SUMMARY OF THE INVENTION

The present invention relates to an injection system for intermittent fuel supply in combustion chambers of an I.C. engine, and more particularly, to an accumulator-type injection system in which a nozzle needle is arranged in the injector body to be displaceable in a longitudinal direction of the injector and, in injection pauses, is configured to be held by a spring on a seat thereof in the injector body. When radial surfaces of the nozzle needle are acted upon by accumulated pressure, the needle lifts from the seat thereof in the injector body and opens up orifices. A control valve controls the injection between two switching positions whereby, in one of the switching positions, an injection passage is opened up to connect a fuel duct in the injector body with an injection pipe and, in the other of the switching positions, closes off the passage in the injection pauses.

For reducing smoke oxides and nitrogen oxides in the exhaust gas of a diesel internal-combustion engine, it is a known technique to inject water into the cylinders together with the fuel.

Gerhard Lehner in "Diesel Injection for Large Engines" in *MTZ Motortechnische Zeitschrift* 55 (1994) 9, pages 502, 511 and 512, describes an accumulator-type injection system. The injector used there is constructed with a spring-loaded nozzle needle. For the injection, a passage is opened up by a magnetic valve and connects the pressure accumulator with a fuel duct in the nozzle body leading to the orifices. The fuel pressure acting on the radial surfaces of the nozzle needle lifts the nozzle needle from its seat in the injector body, whereby the orifices are opened up. In the injection pauses, the nozzle needle is not loaded by the accumulated pressure but by the stationary pressure which depends on the stiffness of the spring which pushes the nozzle needle against its seat in the injector body. Because the stiffness of the spring must be high for correct functioning, the stationary pressure in the injection pauses will also not be low.

German Patent Application P 43 41 739, which is no prior publication, discloses an accumulator-type injection system whose nozzle needle is controlled hydraulically. The high pressure of the fuel accumulator acts in a control space with a piston which is connected with the nozzle needle and holds the nozzle needle in a closed position in the injection pauses. At the same time, in the injection pauses, an annulus on the nozzle needle, which is connected with the orifices, is connected by way of another electromagnetic valve with a return flow pipe. For this reason, the fuel pressure is very low in front of the orifices, between the injections, and water can be transported at a relatively low pressure in front of the orifices. For triggering the injection, the above-mentioned magnetic valves must each be switched over. The control space is relieved from pressure, and the annulus in front of the orifices is connected with the fuel accumulator.

An object of the present invention is, in an accumulator-type injection system, to provide a simple way of lowering the fuel pressure existing in front of the orifices during the injection pauses to approximately the ambient pressure.

The foregoing object has been achieved in accordance with the present invention by providing that in the injection pauses, the fuel duct is connected with the return flow pipe by a passage opened up by the control valve, and, in the injection pauses, the pump delivers water in front of the orifices via a pipe.

For controlling the injection and for lowering the fuel pressure to values below the stationary pressure corresponding to the spring stiffness, a single control valve will be sufficient for two switching positions. In a first switching position, in a known manner, an annulus on the nozzle needle situated in front of the orifices is connected by a fuel duct in the injector body with an injection pipe connected with the fuel accumulator. For this purpose, a corresponding first passage is opened up. In the second switching position, when the above-mentioned passage is closed, a second passage is opened up instead which connects the fuel duct, which leads in front of the orifices, with a return flow pipe.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
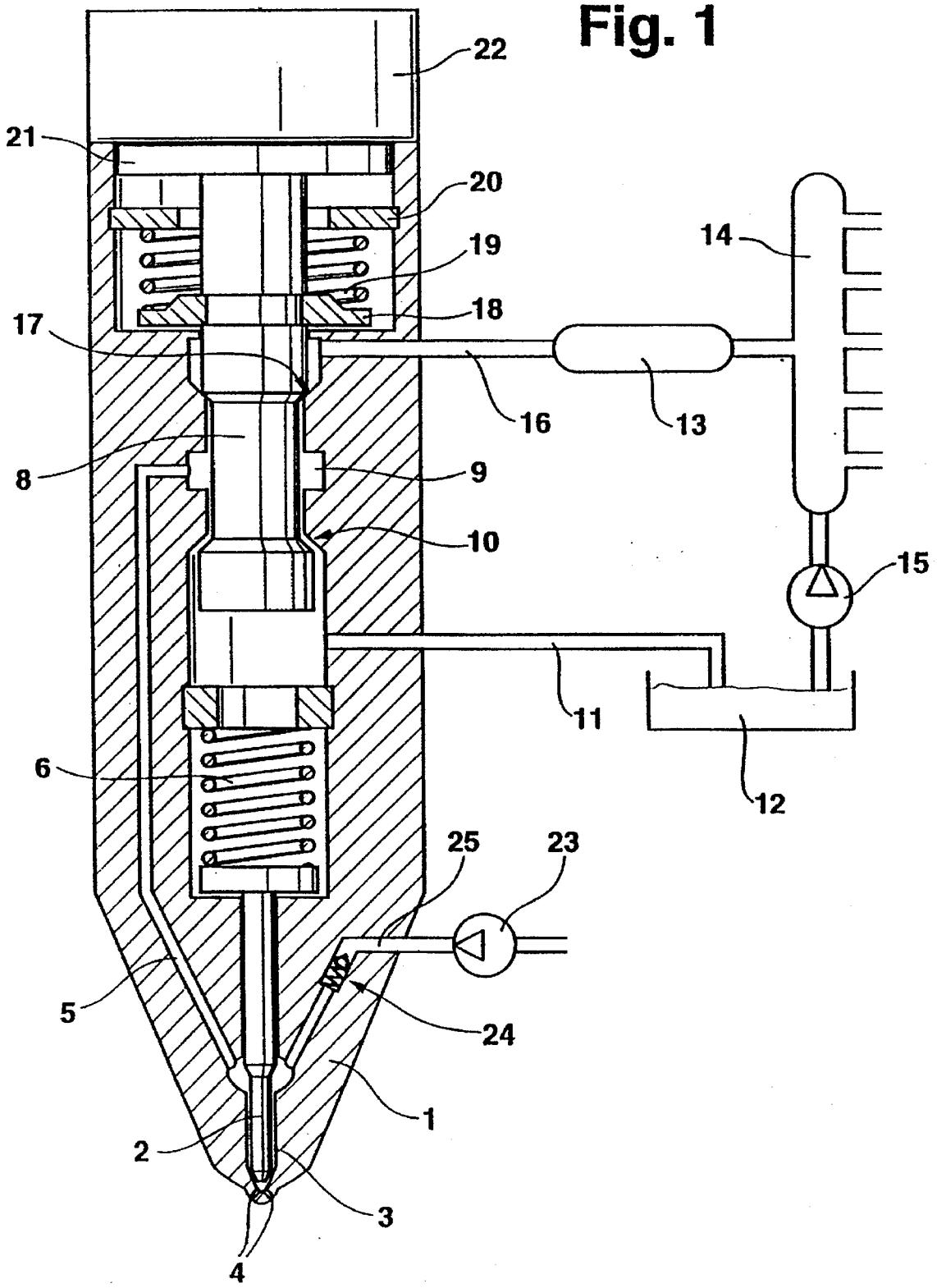
FIG. 1 is a cross-sectional view of an injector of a common rail system according to the present invention.

The internal-combustion engine injector illustrated in FIG. 1 is connected by way of an injection pipe 16 and an intermediate accumulator 13 with a fuel accumulator 14 into which fuel is delivered at a high pressure by a fuel pump 15 from a storage tank 12. In the injector body 1 of the injector, a nozzle needle 2 is arranged to be displaced against the force of a spring 6 in the longitudinal direction of the injector and which, in the illustrated position, closes the orifices 4 in the injector body 1.

When the radial surfaces of the nozzle needle 2 are acted upon by the fuel pressure existing in the fuel accumulator 14, the nozzle needle 2 lifts off its seat in the injector body 1 and opens up the orifices 4 for an injection. The control of the injection takes place by a control valve 8 which takes up two switching positions. No injection takes place in the illustrated switching position. The control valve 8 is held in a seat 17 by a spring 19 between two annular disks 18, 20 connected with the control valve 8 or the injector body 1. The seat 17 is formed of projections on the control valve 8 and the injector body 1.

In this first switching position, an annulus 9, which is situated on the control valve 8 and into which a fuel duct 5 leads, is connected by way of a passage with a return flow pipe 11. The passage is formed by projections of an open second seat 10. Because of this connection of the fuel duct 5 with the return flow pipe 11, the fuel pressure in the fuel duct 5 can be lowered to approximately the ambient pressure. As a result, it is possible to deliver by way of a pump 23, a pipe 25 and a flap valve 24, water at low pressure into the annular duct 3 in front of the orifices 4. The fuel, which is displaced by the delivery of water, flows by way of the return flow pipe 11 into the storage tank 12. During the injection, the water, which is disposed in front of the orifices 4 in this manner, is injected together with fuel into the combustion chambers of the internal-combustion engine.

For the injection, an injector magnet 22 is energized. As a result, the valve disk 21 and thus the entire control valve 8 is pulled upwardly until the projections forming the second seat 10 and the injector body rest against one another. In this second switching position, no fuel can flow from the annulus 9 into the return flow pipe 11. Instead, high-compression fuel flows from the fuel accumulator 14 by way of the now open seat 17 and the annulus 9 into the fuel duct 5 in front of the orifices 4. Due to the increasing pressure, the nozzle needle is pushed against the spring 6. This is the start of the injection. After the magnet 22 is de-energized, the control valve 8 closes the seat 17 by way of the spring force so that fuel will only be injected until the pressure in the fuel duct 5 has fallen under the opening pressure of the spring 6. Because the seat 10 is now open again, the fuel pressure in the fuel duct continues to drop down to the pressure existing in the return flow pipe 11.

Figure 2:
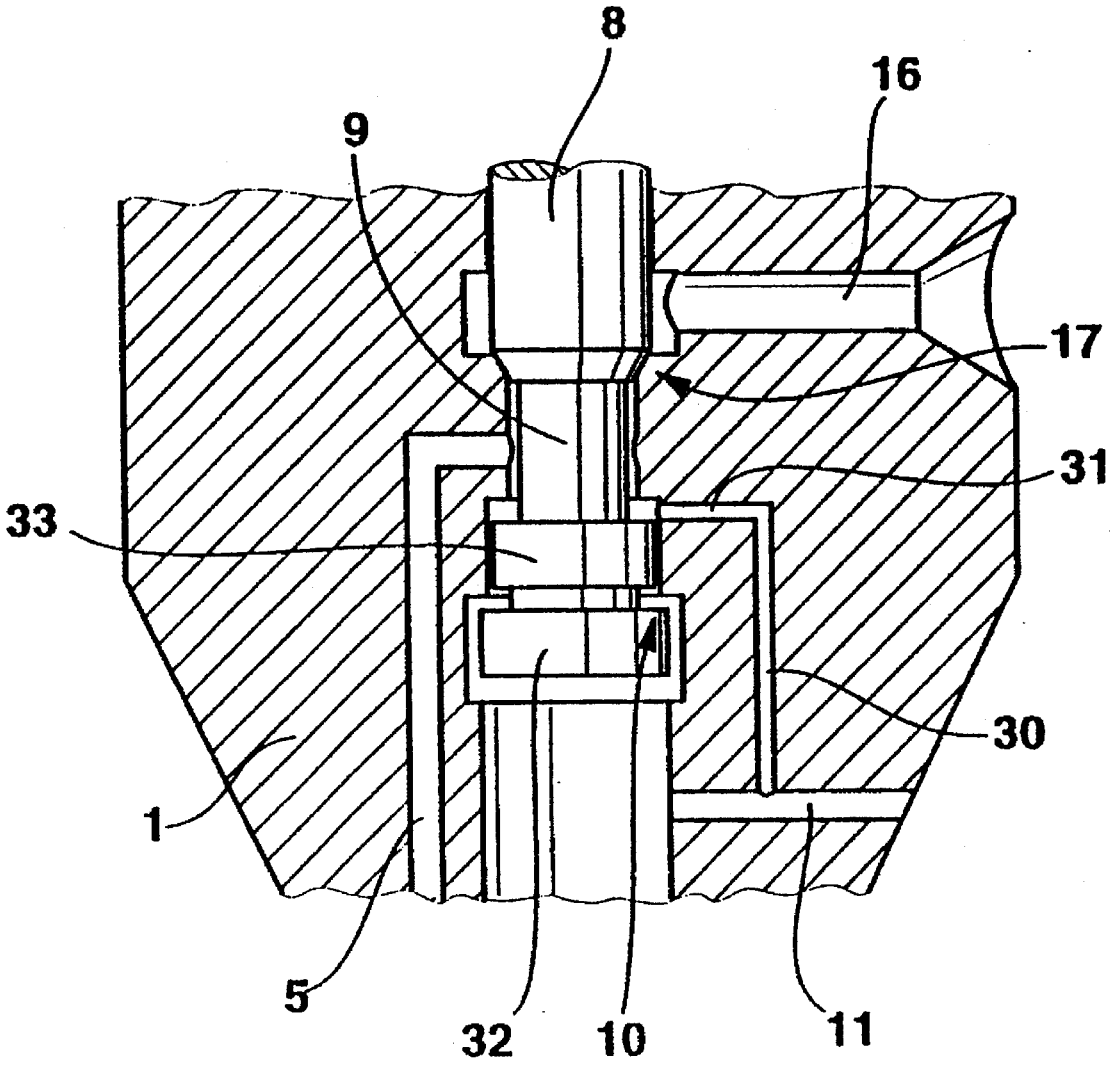
FIG. 2 is a partial view of the injector of FIG. 1 with an alternative way of constructing the passage to the return flow pipe.

FIG. 2 shows a section of the injection nozzle illustrated in FIG. 1. Here, however, the lower portion of the control valve 8 has a different construction. The lower seat 10 is formed by an upper radial surface on a collar 32. Together with cylindrical surfaces of the injector body 1, another collar 33 forms a guide. A bore 31 starts out from the guide surface and is connected with the return flow pipe 11 by way of another bore 30. In the illustrated position, excess fuel flows from the fuel duct 5 into the return flow pipe 11. During the injection, the control valve rests in the seat surfaces of the seat 10, in which case, at the same time, the bore 31 is covered by the circumferential surface of the collar 33. Consequently, no fuel can therefore flow off by way of the bore 31.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An injection system for an intermittent fuel supply in combustion chambers of an internal-combustion engine, comprising injectors, a pump configured and arranged to continuously deliver fuel into a fuel accumulator, a return flow pipe, and injection pipes adapted to connect the fuel accumulator with the injectors each having an injector body, a nozzle needle arranged in the injector body to be displaceable in a longitudinal direction of the injector and, in injection pauses, is configured to be held by a spring on a seat thereof in the injector body and which, when radial surfaces of the nozzle needle are acted upon by accumulated pressure, lifts from the seat thereof in the injector body and opens up orifices, and a control valve controlling the injection between two switching positions whereby, in one of the switching positions, an injection passage is opened up to connect a fuel duct in the injector body, which is connected with the orifices, with an associated one of the injection pipes, and, in the other of the switching positions, closes off the injection passage in the injection pauses, wherein in the injection pauses, a passage opened up by the control valve connects the fuel duct with the return flow pipe and a pipe is arranged to deliver water from the pump to a front area of the orifices, wherein the control valve is displaceable back and forth between the two switching positions formed by seats, on the control valve and the injector body, the control valve has a portion situated between the seats which is surrounded by an annulus which is connected with the fuel duct, during the injection, the seat surfaces of the seat situated on one side of the annulus which are spaced apart form a passage which connects the injection pipe with the annulus while the seat surfaces of the seat resting against one another on the opposite side of the annulus seal off the annulus with respect to a space connected with the return flow pipe, and, in the injection pauses, the control valve rests in one of the seats while the seat surfaces of another of the seats are situated apart and thus form a passage from the annulus to the return flow pipe.

2. An injection system for an intermittent fuel supply in combustion chambers of an internal-combustion engine, comprising injectors, a pump configured and arranged to continuously deliver fuel into a fuel accumulator, a return flow pipe, and injection pipes adapted to connect the fuel accumulator with the injectors each having an injector body, a nozzle needle arranged in the injector body to be displaceable in a longitudinal direction of the injector and, in injection pauses, is configured to be held by a spring on a seat thereof in the injector body and which, when radial surfaces of the nozzle needle are acted upon by accumulated pressure, lifts from the seat thereof in the injector body and opens up orifices, and a control valve controlling the injection between two switching positions whereby, in one of the switching positions, an injection passage is opened up to connect a fuel duct in the injector body, which is connected with the orifices, with an associated one of the injection pipes, and, in the other of the switching positions, closes off the injection passage in the injection pauses, wherein in the injection pauses, a passage opened up by the control valve connects the fuel duct with the return flow pipe and a pipe is arranged to deliver water from the pump to a front area of the orifices, wherein the control valve is displaceable back and forth between the two switching positions formed by the seats on the control valve and the injector body, the control valve has a portion surrounded by an annulus which is connected with the fuel duct, during the injection, seat surfaces of the seat situated on one side of the annulus which are spaced apart form a passage which connects the injection pipe with the annulus and, on a side of the annulus situated opposite the seat, the control valve is connected with a collar having a guide and a circumferential surface covering a bore leading out into the guide of the collar in the injector body, which bore is connected with the return flow pipe, and, in the injection pauses, the control valve rests in the seat which seals off the annulus with respect to the injection pipe, and the bore is connected with the annulus.

* * * * *